US006238209B1

(12) United States Patent
Iida

(10) Patent No.: US 6,238,209 B1
(45) Date of Patent: May 29, 2001

(54) HEARTH ROLLS FOR HEATING FURNACE AND SOAKING FURNACE OF VERTICAL HEAT TREATING FURNACE AND VERTICAL HEAT TREATING FURNACE INCLUDING HEARTH ROLLS

(75) Inventor: Sachihiro Iida, Chiyoda-ku (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/572,449

(22) Filed: May 17, 2000

(51) Int. Cl.[7] ..... F26B 13/14

(52) U.S. Cl. ..... 432/59; 432/246; 432/8; 492/27; 226/190

(58) Field of Search ..... 432/8, 59, 60, 432/228, 236, 246; 219/469; 492/27, 46; 226/190

(56) References Cited

U.S. PATENT DOCUMENTS

| | | | | |
|---|---|---|---|---|
| 3,070,362 | | 12/1962 | Young et al. . | |
| 4,158,128 | * | 6/1979 | Evdokimov et al. | 219/469 |
| 4,571,274 | * | 2/1986 | Yanagishima et al. | 432/8 |
| 5,253,026 | * | 10/1993 | Tamary | 219/469 |

FOREIGN PATENT DOCUMENTS

| | | |
|---|---|---|
| 52-136812 | 11/1977 | (JP) . |
| 55-100919 | 8/1980 | (JP) . |
| 57-137431 | 8/1982 | (JP) . |
| 58-120739 | 7/1983 | (JP) . |
| 59-116331 | 7/1984 | (JP) . |
| 3-47926 | 2/1991 | (JP) . |
| 7-138656 | 5/1995 | (JP) . |
| 7-331335 | 12/1995 | (JP) . |
| 8-199247 | 8/1996 | (JP) . |
| 09 031550 | 2/1997 | (JP) . |
| 52 136812 | 11/1997 | (JP) . |
| 10 298666 | 11/1998 | (JP) . |

* cited by examiner

*Primary Examiner*—Gregory Wilson
(74) *Attorney, Agent, or Firm*—Oliff & Berridge, PLC

(57) ABSTRACT

A vertical heat treating furnace for passing a metal strip, therethrough for heat treatment and a hearth roll applied to a heating/soaking furnace of the vertical heat treating furnace are disclosed. The hearth roll can be configured such that the taper angle of each of first taper sections continuous to a flat section at a central portion of the hearth roll from a roll axial direction is larger than the taper angle of each of second taper sections continuous to each of the first taper sections from the roll axial direction. The length Lc (mm) of the flat section and the length L1 (mm) of the first taper section can satisfy the following relationships: $0.5\,Wmin \leqq Lc \leqq Wmin$ and $Wmin \leqq Lc + 2 \times L1 \leqq Wmax - 400$, where Wmin is the minimum width (mm) of the metal strip, and Wmax is the maximum width (mm) of the metal strip.

15 Claims, 6 Drawing Sheets

HEARTH ROLLS FOR HEATING FURNACE AND SOAKING FURNACE OF VERTICAL HEAT TREATING FURNACE AND VERTICAL HEAT TREATING FURNACE INCLUDING HEARTH ROLLS

BACKGROUND OF THE INVENTION

1. Field of Invention

The present invention relates to hearth rolls for a heating furnace and a soaking furnace of a vertical heat treating furnace. The present invention also relates to a vertical heat treating furnace using the hearth rolls.

2. Description of Related Art

Vertical heat treating furnaces are ordinarily divided into respective sections of a heating furnace, a soaking furnace, and a cooling furnace, and a predetermined heat treatment cycle is performed. Hereinafter, the heating furnace and the soaking furnace contained in the vertical heat treating furnace are described as one set of equipment in the present invention, and are referred to as "a heating/soaking furnace." Further, the vertical heat treating furnace includes a plurality of hearth rolls as transfer rolls located on the upper portion and the lower portion of the vertical heat treating furnace, and a metal strip is passed while being suspended by these hearth rolls and subjected to a necessary heat treatment in the process.

However, because metal strips to be passed are not always flat and include a bent portion and a locally extended portion, a transfer problem such as meandering and the like is liable to occur while they are being passed.

In particular, large vertical heat treating furnaces (of such class in which the distance between upper rollers and lower rollers exceeds 15–20 m) have been constructed in large numbers, and the prevention of transfer problems is a leading problem to be solved in these furnaces. To prevent problems in the transfer of metal strip, the shape of hearth rolls has been variously devised such as by the formation of a crown and the like on the hearth rolls. However, when a large crown is formed to prevent meandering as a transfer problem, there is a possibility that a problem called "buckling", in which a metal strip is buckled in a width direction, can occur. This problem is significant, particularly when the furnace temperature is high and a problem is caused when a sheet is passed. Thus,, buckling is one of leading causes of lowered operating efficiency of equipment and product yield.

There have been made various devices to effectively prevent meandering and buckling, which are problems caused when a metal strip is passed in a vertical heat treating furnace.

Japanese Unexamined Patent Application Publications Nos. 55-100919 and 57-137431, for example, disclose controlling the crown of a roll using the thermal expansion in a hearth roll by devising the inner structure of the hearth roll.

Further, Japanese Unexamined Patent Application Publications Nos. 7-331335 and 3-47926 disclose controlling the crown of a hearth roll by controlling its temperature by applying heat to the hearth role from the outside.

Japanese Unexamined Patent Application Publications Nos. 8-199247, 7-138656, 58-20739, and 52-136812 disclose conventional examples in which the shape of a hearth roll itself is devised. These publications disclose a hearth roll having a one-stepped taper, which is arranged such that the central portion of the hearth roll has a flat shape or a crown shape, with both sides of the roll having a taper.

The applicant has disclosed in Japanese Unexamined Patent Application Publication No. 59-116331 that a roll having a two-stepped taper shape can be used together with the above roll having a one-stopped taper shape and a crown shape.

Recently, however, a steel sheet having width much larger than that of a conventional steel sheet has been required as a steel sheet for integrally forming an automobile body.

Therefore, it has been required to pass a metal sheet, in particular, a steel sheet having a wider range of sheet width, which is larger than a conventional range, in a single vertical heat treating furnace.

Regarding a steel sheet for automobiles, a line was conventionally operated with a sheet width ranging from 800 mm to 1500 mm. Recently, it has been required to pass a steel sheet having a sheet width of about 800–1500 mm, and sometimes a steel sheet having a sheet width larger than this, in the same line.

When a range of sheet width is wide as described above, a transfer problem cannot be sufficiently overcome by simply devising only the roll shape of a one-stepped taper roll as in the conventional technology.

An optimum roll shape has been known as to the one-stepped taper roll and used as an effective means for preventing meandering and buckling in the operation in the conventional range of sheet width. However, the roll shape cannot be used as it is in a wide range of sheet widths having a ratio of maximum to minimum sheet width of, for example, 2 or more.

The present inventors have discovered the one-stepped taper roll has a problem in that while it can effectively prevent the occurrence of buckling in a wide metal strip when the inclination of a taper is reduced, meandering is liable to occur in a narrow metal strip. In contrast, when the inclination of the taper is increased, while meandering can be effectively prevented in a narrow metal strip, buckling is liable to occur in a wide metal strip, particularly when its thickness is thin. Thus, it is impossible to follow a wide range of sheet width and to cope with a problem caused by the wide range of sheet width by the use of the one-stepped taper roll.

Further, even if the method of controlling the crown of a hearth roll by temperature control is applied, it is impossible to follow the wide range of sheet thickness and to cope with a problem caused by the wide range using this method, and it is necessary to reconfigure equipment on a large scale to follow the wide range of sheet width.

Further, a metal strip can be passed stably in a vertical heat treating furnace even by a conventional hearth roll to a certain extent when the metal strip is in a steady state in which it is passed at an approximately constant speed. However, when operating conditions are varied in a furnace to treat metal strips having a wide variety of sizes and various kinds of metal strips, the sheet passing speed is often changed considerably. Meandering and buckling often occur when the speed is changed (by changes corresponding to 40–50% of a steady speed). In the conventional hearth roll, it is very difficult to achieve a stable sheet passing property by taking even the change of sheet passing speed into consideration, and further it is not easy to achieve this property even by the use of the two-stepped taper roll.

In a continuous annealing furnace for steel strip, for example, an ordinary sheet passing speed is about 200–400 m/min in a steady state.

SUMMARY OF THE INVENTION

The present invention can cope with the transfer of a steel strip in a wide range of sheet width only by simply optimizing a hearth roll at a low equipment cost without the need for remodeling equipment on a large scale. The present invention is preferable to a heating/soaking furnace of a vertical heat treating furnace for treating a steel strip having a wide range of sheet width in which a rate of maximum to minimum sheet width is 2 or more.

The inventors have discovered that meandering and buckling can be prevented by optimizing the shape and disposition of two-stepped taper rolls more effectively than conventional taper rolls also in correspondence particularly to a wide range of sheet width and to a change in speed.

That is, the above-described problem of the known apparatus have been solved by a hearth roll for a heating/soaking furnace of a vertical heat treating furnace, which comprises a flat section at a central portion and two-stepped taper sections on both sides of the flat section. The inclination of each of first taper sections continuous to the flat section is larger than the inclination of each of second taper sections further continuous to each of the first taper sections. The length Lc (mm) of the flat section and the length L1 (mm) of each of the first taper sections are related according to the following formulas (1) and (2).

Preferably, a convex curve section and a concave curve section are formed at the boundary between the flat section and each of the first taper sections, and at the boundary between each of the first taper sections and each of the second taper sections, respectively. Each of the convex and concave sections has a radius of curvature of at least 20 m.

Preferably, the inclination R1 of each of the first taper sections is within the range of $0.2\times10^{-3}$ to $10\times10^{-3}$, and the inclination R2 of each of the second taper sections is within the range of $0.05\times10^{-3}$ to $4\times10^{-3}$.

The above-described problems have been solved by a vertical heat treating furnace using hearth rolls for a heating/soaking furnace. The hearth rolls at the inlet of the vertical heat treating furnace satisfy the following formulas (3) and (4) and the hearth rolls from the intermediate portion to the outlet of the vertical heat treating furnace satisfy the following formulas (5) and (6), as well as the lengths Lc and (Lc+2×L1) are increased from the inlet to the outlet of the furnace, stepwise or sequentially, in the hearth roll groups of the respective ones of upper rolls and lower rolls disposed side by side in the furnace.

Further, the above-described problem have been solved by a vertical heat treating furnace using hearth rolls for a heating/soaking furnace an transfer rolls. The hearth rolls at the inlet of the vertical heat treating furnace satisfy the following formulas (3), (4), (7) and (8), and the hearth rolls from the intermediate portion to the outlet of the furnace satisfy the following formulas (5), (6), (9) and (10), as well as the lengths Lc and (Lc+2×L1) are increased from the inlet to the outlet of the furnace, stepwise or sequentially, in the hearth roll groups of the respective ones of upper rolls and lower rolls disposed side by side in the furnace and the inclinations R1 and R2 of the tapers are reduced from the inlet to the outlet of the furnace stepwise or sequentially.

$$0.5W\min \leqq Lc \leqq W\min \quad (1)$$

$$W\min \leqq Lc+2\times L1 \leqq W\max-400 \quad (2)$$

$$0.5W\min \leqq Lc \leqq 0.7W\min \quad (3)$$

$$W\min \leqq Lc+2\times L1\ (W\min+W\max-400)/2 \quad (4)$$

$$0.7W\min \leqq Lc \leqq W\min \quad (5)$$

$$(W\min+W\max-400)/2 \leqq Lc+2\times L1 \leqq W\max-400 \quad (6)$$

$$3.0\times10^{-3} \leqq R1 \leqq 10\times10^{-3} \quad (7)$$

$$1.2\times10^{-3} \leqq R2 \leqq 4.0\times10^{-3} \quad (8)$$

$$0.2\times10^{-3} \leqq R1 \leqq 3.0\times10^{-3} \quad (9)$$

$$0.05\times10^{-3} \leqq R2 \leqq 1.2\times10^{-3} \quad (10)$$

where,

Wmin is the minimum width (mm) of metal strip to be subjected to heat treatment, and Wmax is the maximum width (mm) of metal strip to be subjected to heat treatment.

The furnace may be optionally partitioned into the inlet portion, the intermediate portion and the outlet portion of the furnace.

Further, the stepwise increase of the length means that the value of Lc and the like is increased in the next roll in adjacent rolls (when upper rolls and lower rolls are handled as belonging to different roll systems, adjacent rolls in each system) at least any one position from the inlet to the outlet of the furnace, while the same value may be sometimes set in the adjacent rolls. This is also applicable to the case in which the inclinations R1 and R2 are reduced stepwise. It is contemplated as a typical case of the above arrangement to separate the interior of the furnace into several blocks and to change the value among the blocks.

DETAILED DESCRIPTION OF PREFERRED EMBODIMENTS

Figure 1:
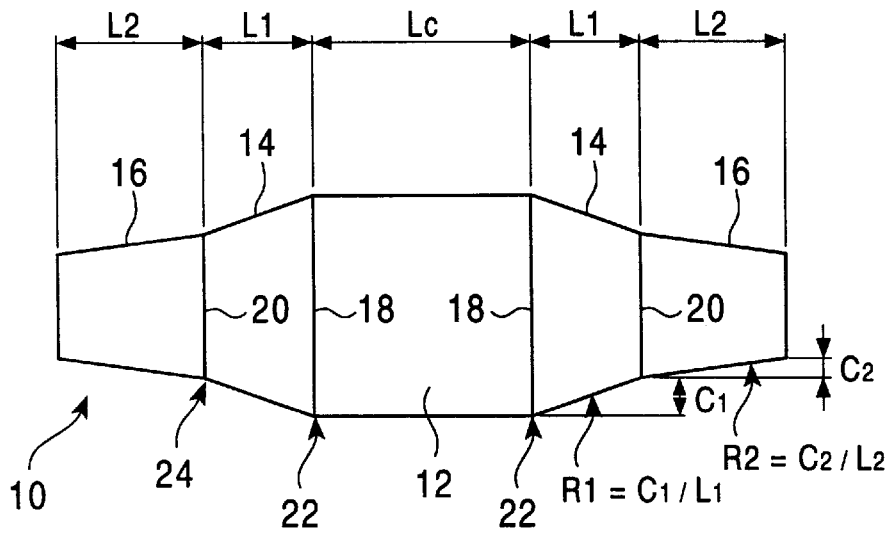
FIG. 1 illustrates an exemplary embodiment of a hearth roll of the present invention.

First, a two-stepped taper roll, which is used as an embodiment of a hearth roll of the present invention, will be described with reference to FIG. 1.

The hearth roll 10 of the present invention has a two-stepped taper structure, which is symmetrical on the right and left sides of the hearth roll 10. The hearth roll 10 includes a flat section 12 having a length of Lc (mm) formed at the central portion of the hearth roll 10, first taper sections 14 each having a length of L1 (mm) formed on both sides of the flat section 12, and second taper sections 16 each having a length of L2 (mm) formed on both sides of the first taper sections 14.

The flat section 12 may be approximately flat and, for example, may be formed as a gentle curved surface having a radius of curvature of, for example, at least 100 m.

When the inclination of each the first taper sections 14 (C1/L1) is represented by R1, and the inclination of each of the second taper sections 16 (C2/L2) is represented by R2, then R1>R2.

Further, it is preferable that the boundary 18 between the flat section 12 and each of the first taper sections 14, and the boundary 20 between each of the first taper sections 14 and each of the second taper sections 16 are formed in a round shape without any corner as a catching part. It is also preferable that these boundaries 18, 20 are arranged as a convex curve section 22 and a concave curve section 24, respectively. However, because it is desirable to make the connecting portions thereof as gentle as possible, it is preferable to set the radii of curvature thereof to at least 20 m, respectively. The two-stepped taper sections 14, 16 on both sides of the flat section 12 are not necessarily symmetrical and the inclinations of the two-stepped taper sections 14, 16 on the right and left sides may be varied, or the widths of the taper sections 14, 16 may be varied.

Figure 2:
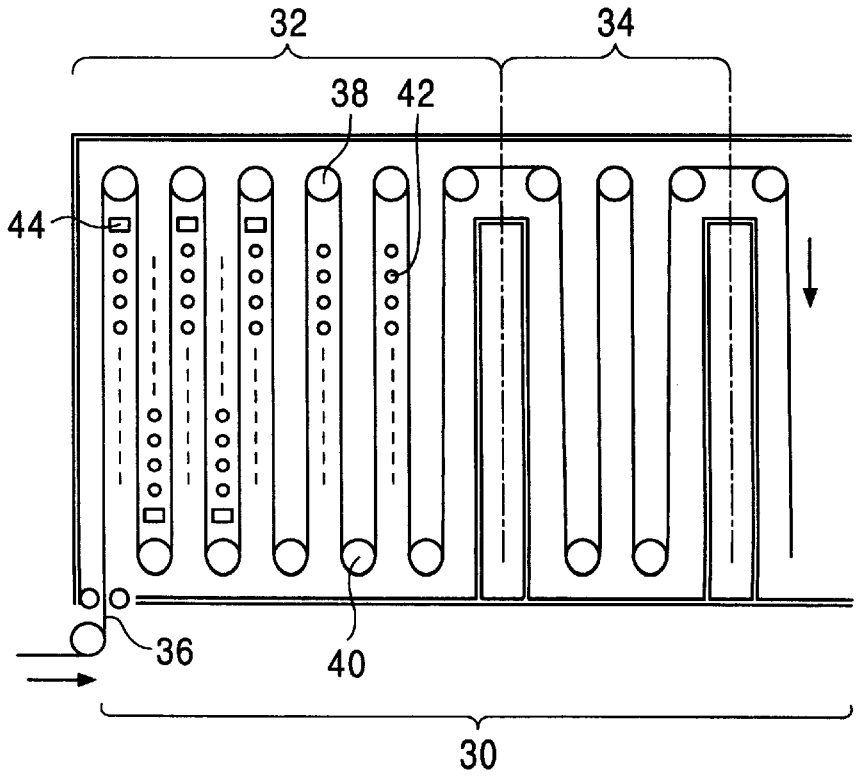
FIG. 2 is a schematic view of a vertical heat treating furnace.

Next, FIG. 2 schematically shows a typical vertical heat treating furnace to which the present invention is applied.

In the example shown in FIG. 2, the vertical heat treating furnace 30 comprises a heating furnace 32 for performing heating, and a soaking furnace 34 for performing soaking, and these furnaces 32, 34 are arranged continuously. A preheating furnace may be disposed in front of the heating furnace 32. At the time, however, the hearth rolls of the preheating furnace can be regarded as the same as a group of hearth rolls on the inlet side of the heating furnace.

A metal strip 36 enters the furnace from the inlet of the vertical heat treating furnace 30. That is, the metal strip 36 enters the heating furnace 32 and is passed while being suspended by upper hearth rolls 38 and lower hearth rolls 40 disposed on the upper side and the lower side, respectively, of the furnace. The metal strip 36, which is passed in the furnace, is heated by heating elements 42. While the heating elements 42 are shown only partly in FIG. 2 for simplicity, a plurality of the heating elements 42 are disposed at desired positions in the heating furnace 32 and the soaking furnace 34. A radiant tube or the like can be used as a heating element.

A shield plate 44 is conventionally interposed between a hearth roll 10 and a heating element 42, such as a radiant tube, so that the crown of the hearth roll 10 is not deformed by the radiant heat from the heating element 42.

The most effective position of the shield plate 44 also has been examined. As a result, it has been confirmed that the effect of the shield plate 44 is not significant in the latter half section of the heating furnace 32 and in the soaking furnace 34 where the temperature of the metal strip 36 approaches the temperature in the furnace and the temperature of the heating element 42. It has also been confirmed that the shield plate 44 has a large effect in the former half section of the heating furnace 32 where the temperature of the metal strip 36 is considerably lower than the temperature in the furnace and the temperature of the heating element 42.

When the shield plate 44 in not used, both of the ends of the hearth roll 10 located in the former half section of the heating furnace 32 are heated by the heating element 42, while the central portion of the hearth roll 10 is kept at a low temperature by the metal strip 36 having a low temperature. Accordingly, the hearth roll 10 is liable to develop a concave crown, whereby the metal strip 36 is liable to be meandered.

It has been found that the installation of the shield plate 44 makes it difficult for both of the ends of the hearth roll 10 to be heated by the heating element 42 so that the crown of the hearth roll 10 remains in a normal state and meandering is reduced.

Figure 3:
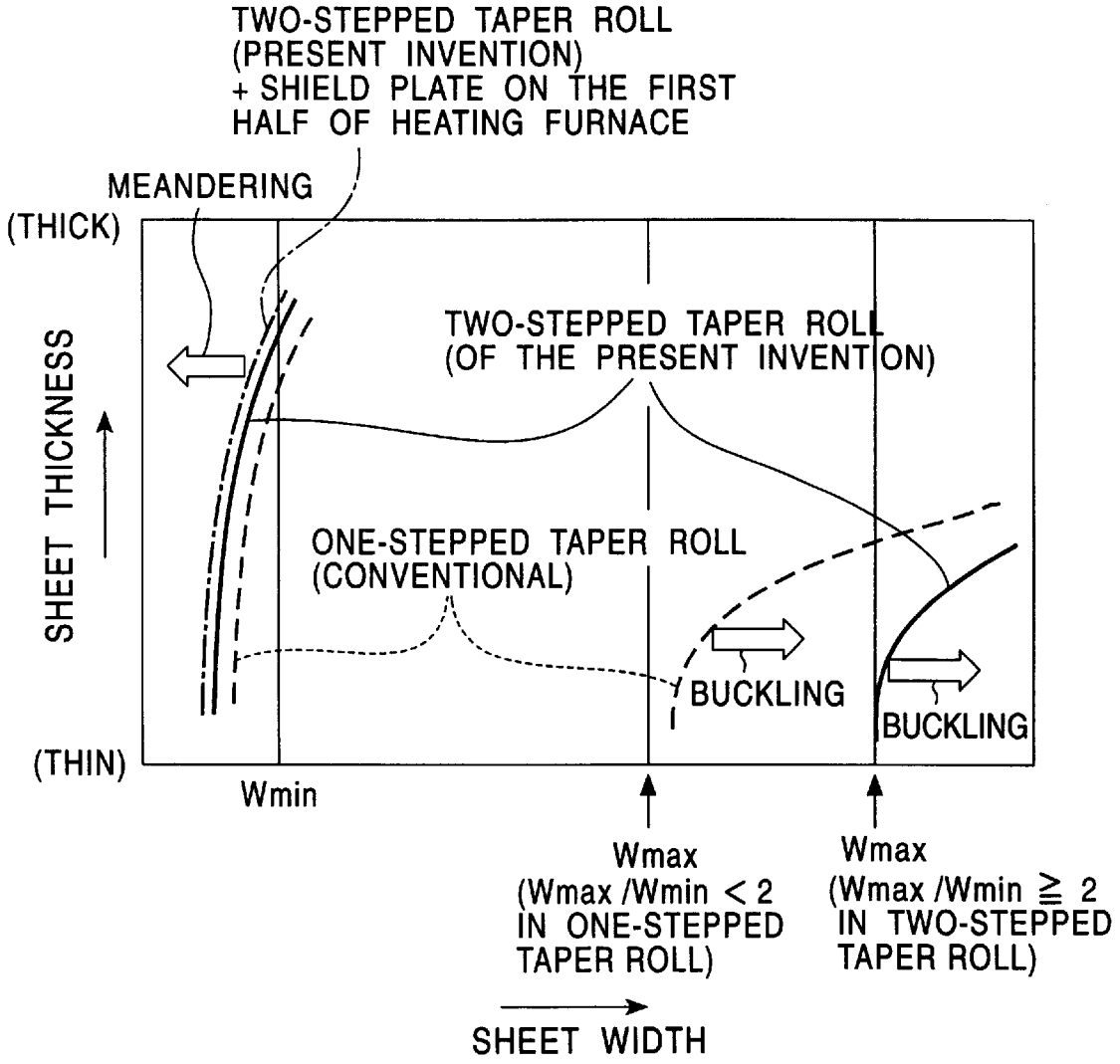
FIG. 3 is a graph showing conditions under which meandering and buckling occur depending upon the width and thickness of sheet.

FIG. 3 graphically illustrates how meandering and buckling properties can be improved, and how operation can be stabilized, by the two-stepped taper roll of the present invention as compared to a conventional one-stepped taper roll. In FIG. 3, the abscissa represents the sheet width of a metal strip passed in the furnace and the ordinate represents the sheet thickness of the metal strip.

The taper angle of the roll, the radius of curvature of the taper boundary of the roll, and the like of the two-stepped taper roll employed in FIG. 3 meet the above-described preferred conditions according to the present invention. Further, the occurrence of respective sheet passing problems was determined depending upon whether the problems were caused when the sheet passing speed was lowered by 50% as compared with an ordinary sheet passing speed (300 m/min). This also is applied likewise to FIGS. 4 and 5 which are described below.

The conventional one-stepped taper roll can approximately prevent meandering and buckling and stabilize operation when the maximum/minimum ratio of sheet width of a metal strip (Wmax/Wmin) is less than 1–2, at most. When, Wmax/Wmin is 2 or more, the occurrence of buckling cannot be completely prevented in a metal strip having a large width and a small thickness even if the length of the flat portion of the hearth roll, the taper length, and the like thereof are variously adjusted.

In contrast, in the two-stepped hearth roll of the present invention, meandering and buckling can be effectively prevented over a wide range in which Wmax/Wmin is 2 or more, so long as satisfactory conditions are used for the hearth roll.

The inventors have conducted more detailed studies based on the above-described knowledge and completed the present invention. The knowledge obtained as a result of the studies carried out by the inventors are described below.

First, the optimum value of the length Lc of the flat portion of a hearth roll 10 hating a two-stepped taper an shown in FIG. 1 is determined based on the minimum sheet width Wmin of a metal sheet to be passed, and it is preferable to set the length Lc as follows:

$$0.5W\min \leqq Lc \leqq W\min \quad (1)$$

When Lc is less than 0.5 Wmin, the width of a sheet is ordinarily made too large at taper portions and buckling is likely to occur.

To cope with this problem, it is preferable to vary the value depending upon the position at which the hearth roll is disposed in the vertical heat treating furnace 30 as shown in FIG. 2, and it has been found that it is most preferable to set the value of Lc to satisfy the relationship 0.5 Wmin≦Lc≦0.7 Wmin at the inlet of the vertical heat treating furnace 30 (that is, at the inlet of the heating furnace 32), to prevent the meandering of a narrow metal strip, and to set the value of Lc to satisfy the relationship 0.7 Wmin≦Lc≦Wmin at a location from the intermediate portion of the furnace to the outlet of the vertical heat treating furnace 30 (that is, the outlet of the soaking furnace 34) because the temperature of the metal strip is increased.

The shape of a sheet is ordinarily improved in the latter half section of the vertical heat treating furnace 30 and meandering is unlikely to occur. Therefore, it has been found that it is effective to set Lc to a larger value within the range of 0.7×Wmin or more to prevent buckling.

Figure 4:
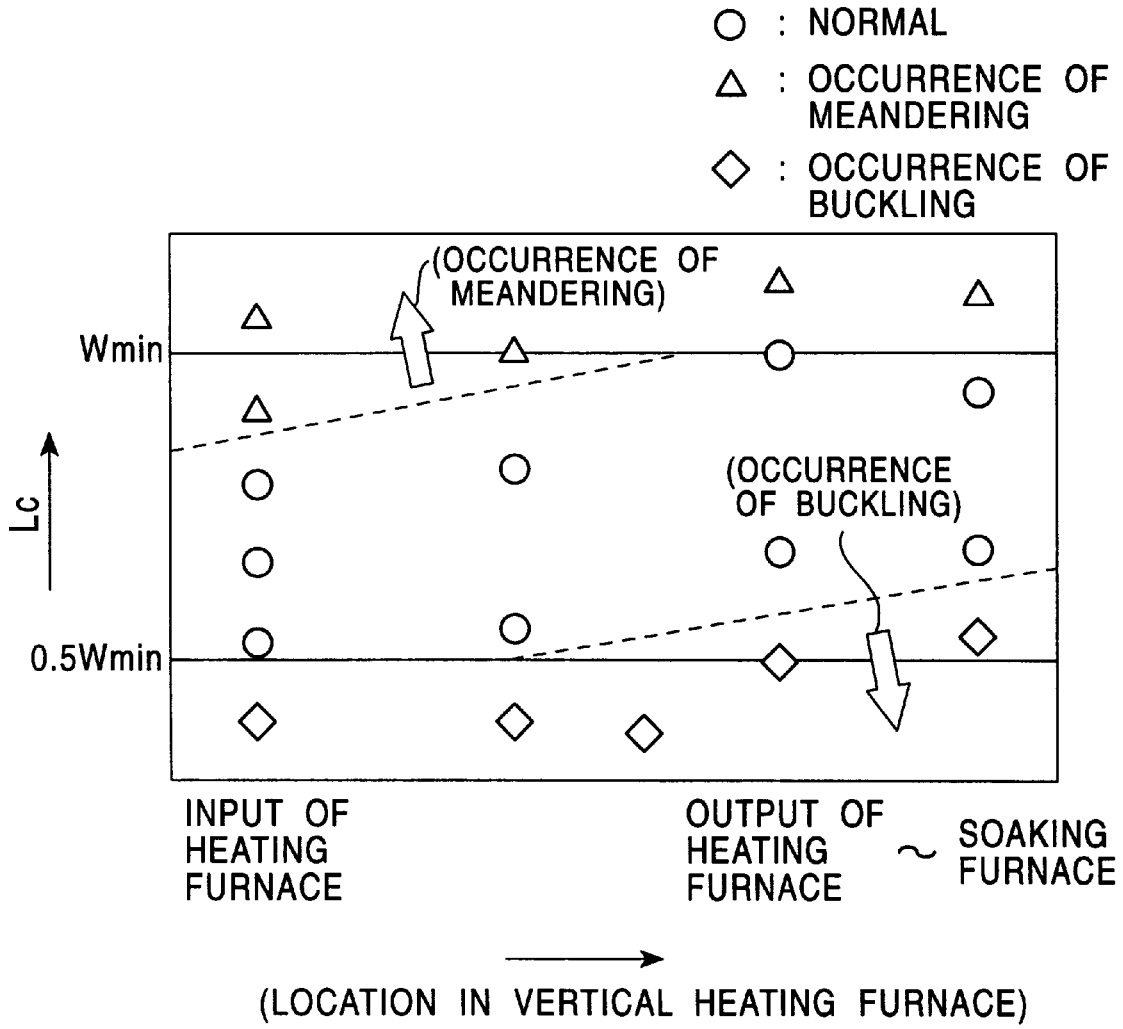
FIG. 4 is a graph showing the condition of Lc under which meandering and buckling occur in a vertical heat treating furnace.

As shown in FIG. 4, when Wmin is too large at the inlet of the heating furnace, meandering often occurs even if the tapers on both of the sides of the hearth roll are variously adjusted, because the shape of a metal strip is not yet completely restored, whereby problems such as the reduction of speed and the like are caused.

On the contrary, unless Lc is set larger from the central portion of the heating furnace 32 to the soaking furnace 34 as compared with the inlet of the heating furnace 32 as shown in FIG. 4, the problem of buckling is often caused in a wide metal strip, even if the tapers on both of the sides of the hearth roll are variously adjusted. However, the maximum value of Lc does not exceed Wmin. This is because if Lc is set larger than Wmin, meandering is caused from the central portion of the heating furnace 32 to the soaking furnace 34 in case of Wmin, while the shape of the metal strip is corrected from the central portion of the heating furnace 32 to the soaking furnace 34.

Next, as a result of repeated studies and tests on actually operating equipment also as to the width L1 of each of the first taper sections, it has been found that it is most preferable to form the hearth roll such that Lc+2×L1 is sequentially increased from the inlet of the heating furnace 32 to the outlet of the heating furnace within the range of the following formula (2):

$$W\min \leqq Lc+2\times L1 \leqq W\max-400 \quad (2)$$

Lc+2×L1 must be set larger than the minimum width Wmin of a metal strip to prevent the meandering of a narrow metal strip. Further, when Lc+2×L1 is larger than the maximum width Wmax−400, buckling is likely to occur in a wide metal strip even if any value is selected as the inclinations R1 and R 2 of the two-stepped taper portions of the hearth roll.

Figure 5:
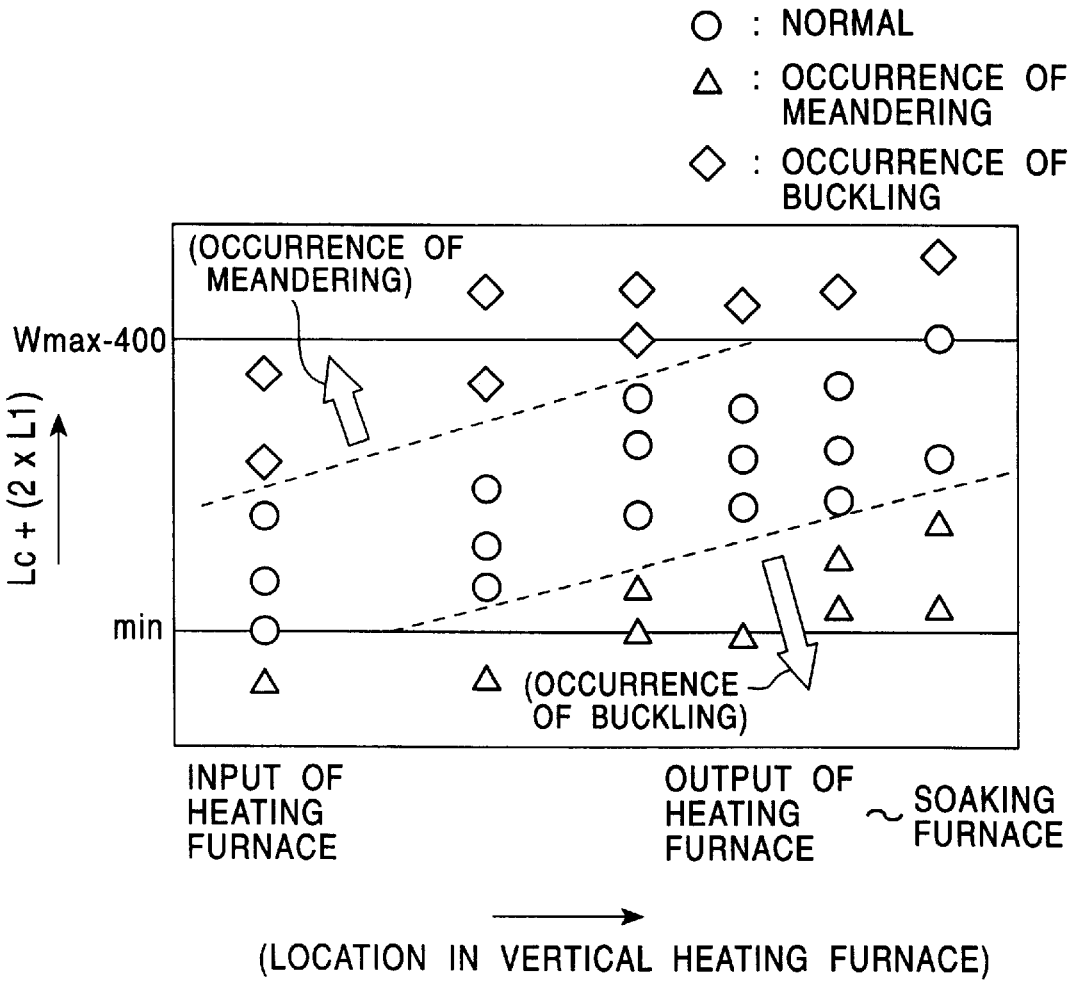
FIG. 5 is a graph showing the condition of (Lc+2×L1) under which meandering and buckling occur in the vertical heat treating furnace.

FIG. 5 shows the optimum range of Lc+2×L1 and how meandering and buckling are caused when the optimum range is not satisfied. It has been found that it is difficult to completely prevent the occurrence of meandering and buckling unless Lc+2×L1 is set properly, even if any value is selected as R1 and R2. Further, it has become apparent that the inclinations R1 and R2 of the taper portions are preferably set when the relationship of R1>R2 is achieved, R1 is set to a value from $0.2\times10^{-3}$ to $10\times10^{-3}$ and R2 is set to a value from $0.05\times10^{-3}$ to $4\times10^{-3}$.

Further, it has been found as to R1 and R2 that it is more preferable for them to satisfy the following relationships: $3.0\times10^{-3} \leqq R1 \leqq 10\times10^{-3}$ and $1.2\times10^{-3} \leqq R2 \leqq 4.0\times10^{-3}$, respectively on the inlet of the furnace, and to satisfy the following relationships: $0.2\times10^{-3} \leqq R1 \leqq 3.0\times10^{-3}$ and $0.05\times10^{-3} \leqq R2 \leqq 1.2\times10^{-3}$, respectively, on the outlet of the furnace. The inclinations R1 and R2 are set as described above because it is preferable to put greater emphasis on the prevention of buckling in the latter half section of the furnace in design likewise in the case of Lc and other parameters.

It is preferable that the respective values of L1 and Lc+2×L1 are sequentially increased from the inlet to the outlet of the vertical heat treating furnace 30, or, in some embodiments, made equal to each other. As a method of sequentially increasing the values, the values may be varied in the former half section and the latter half section of the vertical heat treating furnace 30 by dividing the interior the furnace into the two portions. Otherwise, the values may be sequentially increased at about three to five steps in same embodiments. Further, the values may be sequentially and continuously increased in other embodiments, It also has been found that several special rolls such as CPC (meandering correcting) rolls and the like, which are ordinarily installed in a furnace, are not included in the scope of the roll shape of the present invention because only a small number of these special rolls are typically used, and the effects of the present invention can be sufficiently obtained even if they are arranged as, for example, flat rolls.

It also has been become apparent that while hearth rolls are disposed on the upper portion and the lower portion in the interior of the vertical heat treating furnace 30, it is preferable to sequentially increase the above-described roll parameters (L1,Lc+2×L1) in the individual roll groups of the upper rolls and the lower rolls because tension is differently imposed on a metal strip on the upper portion and the lower portion of the furnace due to the influence of gravity and other factors.

Several examples of the actual shapes of hearth roll (prescribed by Lc and L1) are exemplified in TABLE 1.

TABLE 1 shows the relationship between Lc and L1 of a hearth roll applied in the vertical heat treating furnace for the respective cases of metal strips which are passed through the furnace and whose minimum and maximum widths are Wmin and Wmax.

TABLE 1 shows the minimum value (min), median value (mid) and maximum value (max) of L1 to each of the minimum value (min), median value (mid) and maximum value (max) of Lc as a matrix with respect to the respective cases of Wmin and Wmax. The values shown in the parentheses are not actually used.

In the present invention, it is preferable to use values in the ranges of the min and mid of Lc and the min and mid of L1 at the inlet of the heating/soaking furnace in the vertical heat treating furnace, and it is preferable to use values within the ranges of the mid and max of Lc and the mid and max of L1 from the intermediate portion to the outlet of the heating/soaking furnace in the vertical heat treating furnace.

TABLE 1

| | Wmin | Wmax | Wmax | | L1 (mm) | | | Transfer problem | |
|---|---|---|---|---|---|---|---|---|---|
| case | (mm) | (mm) | Wmin | Lc(mm) | min | mid | max | meadering | buckling |
| 1 | 500 | 1000 | 2.0 | min:250 | 125 | 150 | (175) | ○ | ○ |
| | | | | mid:350 | 75 | 100 | 125 | | |
| | | | | max: 500 | (0) | 25 | 50 | | |
| 2 | 500 | 1500 | 3.0 | min:250 | 125 | 275 | (425) | ○ | ○ |
| | | | | mid:350 | 75 | 225 | 375 | | |
| | | | | max: 500 | (0) | 150 | 300 | | |

TABLE 1-continued

| case | Wmin (mm) | Wmax (mm) | Wmax / Wmin | Lc(mm) | L1 (mm) min | L1 (mm) mid | L1 (mm) max | Transfer problem meadering | Transfer problem buckling |
|---|---|---|---|---|---|---|---|---|---|
| 3 | 800 | 1500 | 1.9 | min:400<br>mid:560<br>max:<br>600 | 200<br>120<br>(0) | 275<br>195<br>75 | (350)<br>270<br>150 | ○ | ○ |
| 4 | 800 | 1800 | 2.3 | min:400<br>mid:560<br>max:<br>800 | 250<br>150<br>(0) | 350<br>270<br>150 | (500)<br>420<br>300 | ○ | ○ |
| 5 | 800 | 2000 | 2.5 | min:400<br>mid:560<br>max:<br>800 | 250<br>150<br>(0) | 400<br>300<br>200 | (600)<br>520<br>400 | ○ | ○ |
| 6 | 1000 | 2000 | 2.0 | min:500<br>mid:700<br>max:<br>1000 | 250<br>150<br>(0) | 400<br>300<br>150 | (550)<br>450<br>300 | ○ | ○ |
| 7 | 800 | 1800 | 2.3 | min:700<br>mid:850<br>max:<br>1000 | 400<br>300<br>250 | 450<br>350<br>275 | 500<br>400<br>300 | X | ○ |
| 8 | 800 | 1800 | 2.3 | min:200<br>mid:300<br>max:<br>400 | 250<br>200<br>150 | 275<br>225<br>175 | 300<br>250<br>200 | ○ | X |

Wmin ≦Lc + 2X L1 ≦ Wmax − 400
Wmin: min width; Wmax: max width
○: no problems
X: occurrence of problems
Lc: length of flat section;
L1: length of first taper sections In the case 7 in which Lc+2×L1 was excessively large, buckling substantially did not occur, but meandering frequently occurred and sheet passing was significantly disturbed.

In contrast, in the case 8 in which Lc+2×L1 was excessively small, buckling frequently occurred in a wide material, while the occurrence of meandering was suppressed.

Figure 6:
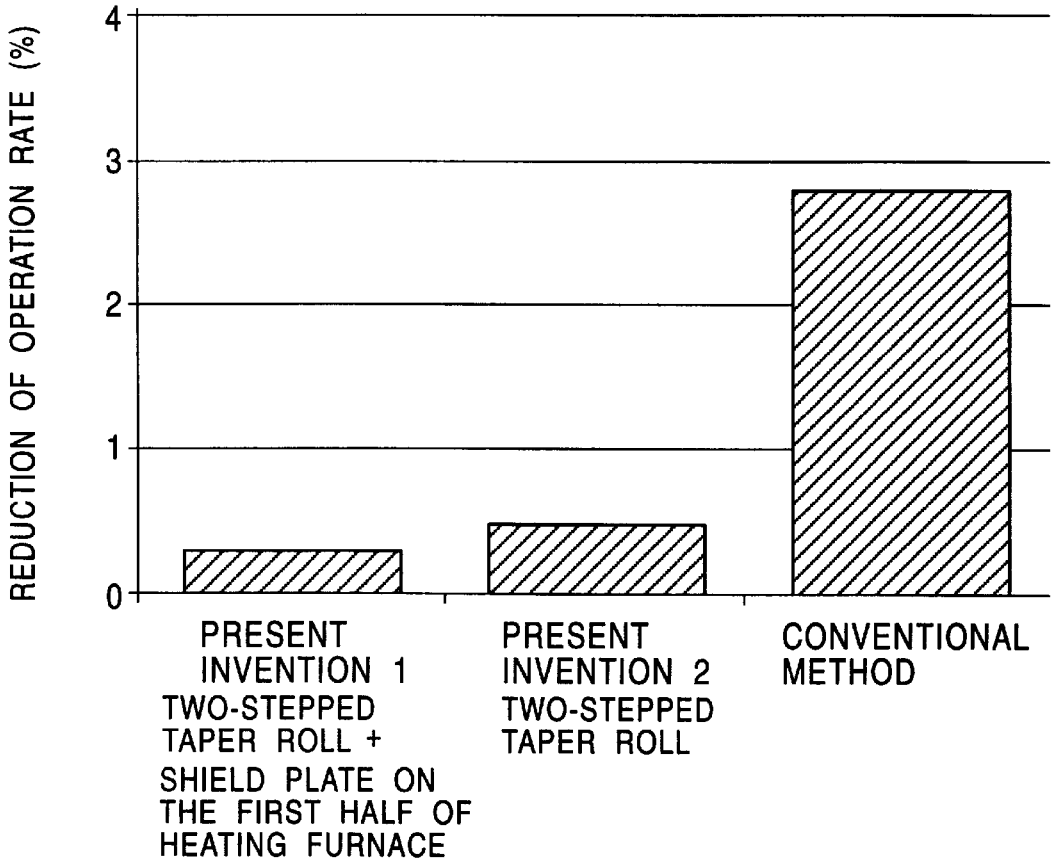
FIG. 6 shows an effect of the present invention of reducing an operation rate resulting from meandering and buckling.
Figure 7:
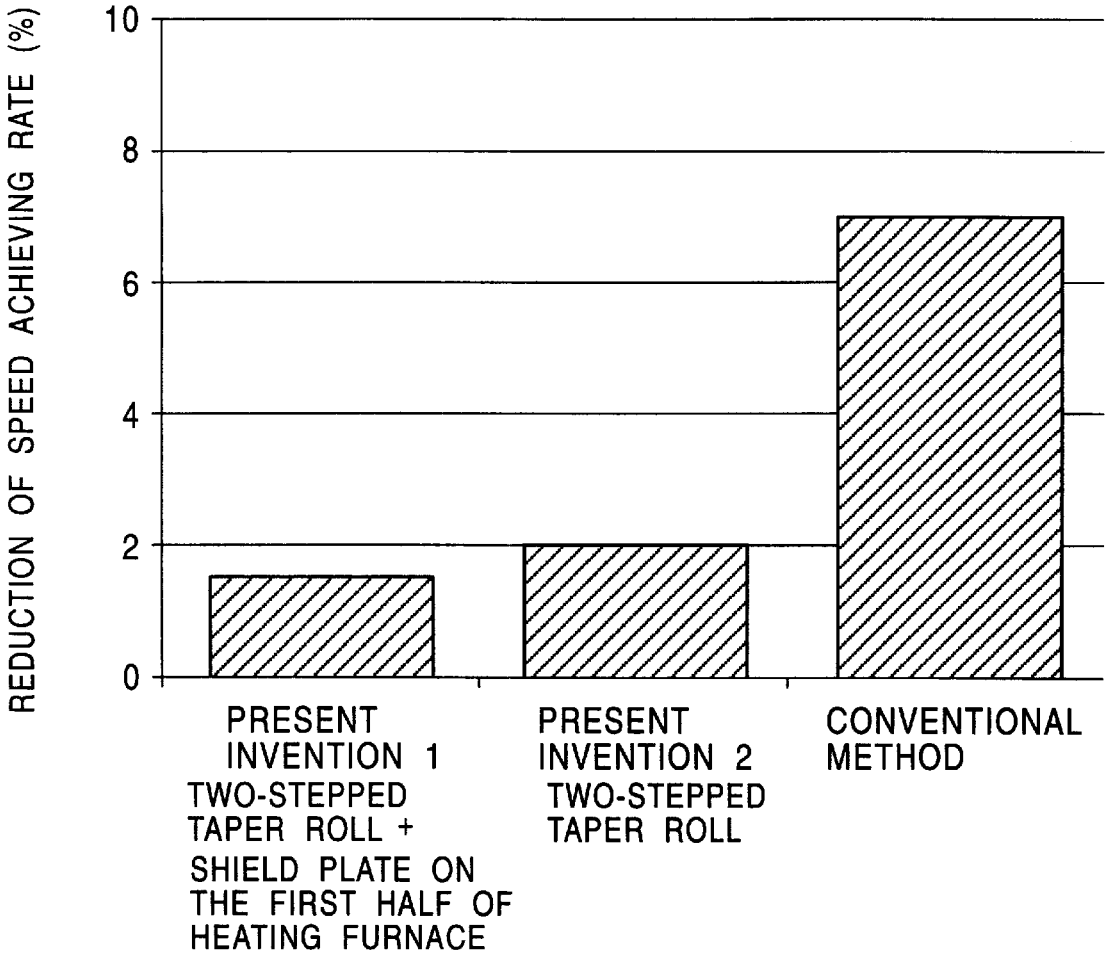
FIG. 7 shows an effect of the present invention of reducing a speed achieving rate resulting from meandering and buckling.

The reduction of the operation rate of equipment and the reduction of a speed achieving rate, which were caused by meandering and buckling, could be greatly improved as shown in FIGS. 6 and 7 by the use of the present invention, in addition to that the yield of product, which was deteriorated by defective products resulting from the stopping of a line, the reduction of the line speed and the like, could be improved by an average of 0.2%.

FIG. 6 shows the reduction of the operation rate of equipment caused by meandering and buckling when the vertical heat treating furnace according to the present invention is used and also when a conventional vertical furnace is used. When a steel sheet in meandered a large amount, or when it is greatly drawn, operation is finally carried out at a lowered speed. However, when the degree of meandering and buckling is greatly increased, the steel sheet must be subjected to a countermeasure by stopping the operation and lowering the temperature of the furnace, which reduces the operation rate of the equipment. In this case, the reduction of the operation rate of the equipment is represented by the rate between a time during which the equipment is interrupted by meandering and buckling and a working time. The reduction of the operation rate, which was conventionally about 3%, can be reduced to 0.5% or less by the employment of the present invention. The working time is typically represented as a possible operation time, which is determined by subtracting the out of work time, the setup change time and the like, from a calendar time.

FIG. 7 shows the reduction of the speed achieving rate of equipment caused by meandering and buckling when the vertical heat treating furnace according to the present invention was employed and when the conventional vertical furnace was employed. The speed achieving rate is the rate between a speed calculated from a capacity of equipment and an actual operation rate, and it serves as an index representing a capacity in operation. When meandering or buckling occurs in a steel sheet, while a countermeasure is typically employed to continue operation without the occurrence of serious disadvantages caused by speed reduction, the speed achieving rate is finally lowered and the desired amount of production cannot be achieved. The reduction of the speed achieving rate, which was conventionally about 7%, can be reduced to about 2% by the employment of the present invention.

Steel strips were passed through continuous annealing furnaces (Nos. 1, 2, 4, 5, and 6) having roll arrangements shown in TABLES 2–4 below and continuous galvanizing furnaces (Nos. 3, 7 and 8) (distance between upper rolls and lower rolls was 20 m and a steady sheet passing speed was 300 m/min).

It has been confirmed in the present invention that even if the sheet passing speed is varied by 40% or more (50% under optimum conditions) in the vertical heat treating furnace capable of coping with a wide range of sheet width (Wmax/Wmin≧2), no meandering and buckling problems occur and sheets can be stably passed.

The shape and size of hearth rolls in the vertical heat treating furnace, that is, in the heating/soaking furnace can be optimized by the present invention and operation can be stably conducted without the occurrence of meandering and buckling in metal strips having a wide range of sheet width. As a result, the occurrence of problems such as the reduction of yield, line stopping, the reduction of line speed, and other problems can be prevented.

TABLE 2

| No. | sheet width (mm) Wmin Wmax | 0.5 Wmin *1 | 0.7 Wmin Wmax-400 | Radius of curvature (m) convex concave | Block 1 (upper line:upper rolls; lower line:lower rolls) hearth rolls (No.) | LC (mm) | L1 (mm) | Lc + 2 × L1 (mm) | R1 ($10^{-3}$) | R2 ($10^{-3}$) | Block 2 (upper line:upper rolls; lower line:lower rolls) hearth rolls (No.) | LC (mm) | L1 (mm) | Lc + 2 × L1 (mm) | R1 ($10^{-3}$) | R2 ($10^{-3}$) |
|---|---|---|---|---|---|---|---|---|---|---|---|---|---|---|---|---|
| 1 | 700 | 350 | 490 | 40 | 1-4 | 350 | 250 | 850 | 5.0 | 2.2 | 5-7 | 500 | 300 | 1100 | 1.5 | 0.8 |
| | 1850 | 1075 | 1450 | 40 | 1-4 | 350 | 250 | 850 | 7.5 | 3.0 | 5-7 | 500 | 300 | 1100 | 2.5 | 1.2 |
| 2 | 900 | 400 | 450 | 30 | 1-3 | 450 | 200 | 850 | 7.0 | 3.0 | 4-5 | 550 | 250 | 1050 | 3.0 | 2.0 |
| | 2000 | 1200 | 1600 | 30 | 1-3 | 450 | 200 | 850 | 10.0 | 4.0 | 4-5 | 550 | 250 | 1050 | 4.0 | 3.0 |
| 3 | 600 | 300 | 420 | 50 | 1-3 | 400 | 250 | 900 | 4.0 | 1.5 | 4-7 | 500 | 300 | 1100 | 0.3 | 0.2 |
| | 1800 | 1000 | 1400 | 50 | 1-3 | 400 | 250 | 900 | 5.5 | 2.5 | 4-7 | 500 | 300 | 1100 | 0.5 | 0.3 |
| 4 | 900 | 450 | 630 | 40 | 1-5 | 600 | 275 | 1150 | 4.8 | 2.0 | 6-7 | 700 | 300 | 1300 | 1.3 | 0.9 |
| | 1900 | 1200 | 1500 | 40 | 1-4 | 500 | 250 | 1000 | 7.2 | 2.8 | 5-6 | 650 | 250 | 1150 | 2.2 | 1.1 |
| 5 | 500 | 250 | 350 | 40 | 1-5 | 300 | 200 | 700 | 5.0 | 2.0 | 6-7 | 400 | 250 | 900 | 2.0 | 1.0 |
| | 1500 | 800 | 1100 | 40 | 1-4 | 300 | 200 | 700 | 7.0 | 3.0 | 5-6 | 400 | 250 | 900 | 3.0 | 1.5 |
| 6 | 700 | 350 | 490 | | 1-4 | 350 | 250 | 850 | 5.0 | 2.2 | 5-8 | 500 | 350 | 1200 | 1.5 | 0.8 |
| | 1800 | 1050 | 1400 | | 1-4 | 350 | 250 | 850 | 7.5 | 3.0 | 5-7 | 500 | 350 | 1200 | 2.5 | 1.2 |
| 7 | 600 | 300 | 420 | 50 | 1-2 | 400 | 250 | 900 | 11.0 | 4.5 | 3-7 | 500 | 300 | 1100 | 0.05 | 0.02 |
| | 1800 | 1000 | 1400 | 50 | 1-2 | 400 | 250 | 900 | 12.0 | 5.0 | 3-7 | 500 | 300 | 1100 | 0.1 | 0.03 |
| 8 | 600 | 300 | 420 | 50 | 1-3 | 400 | 250 | 900 | 3.0 | 1.5 | 4-5 | 500 | 300 | 1100 | 3.5 | 2.0 |
| | 1800 | 1000 | 1400 | 50 | 1-3 | 400 | 250 | 900 | 3.5 | 2.0 | 4-5 | 500 | 300 | 1100 | 4.0 | 2.5 |

*1: (Wmin + Wmax − 400)/2

TABLE 3

| No. | block 3 (upper line:upper rolls; lower line:lower rolls) hearth rolls (No.) | Lc (mm) | L1 (mm) | Lc + 2 × L1 (mm) | R1 ($10^{-3}$) | R2 ($10^{-3}$) | block 4 (upper line:upper rolls; lower line:lower rolls) hearth rolls (No.) | Lc (mm) | L1 (mm) | Lc + 2 × L1 (mm) | R1 ($10^{-3}$) | R2 ($10^{-3}$) |
|---|---|---|---|---|---|---|---|---|---|---|---|---|
| 1 | 8-20 | 600 | 350 | 1300 | 0.2 | 0.1 | | | | | | |
| | 8-20 | 600 | 350 | 1300 | 0.4 | 0.2 | | | | | | |
| 2 | 6-7 | 600 | 300 | 1200 | 1.0 | 0.8 | B-11 | 650 | 350 | 1350 | 0.4 | 0.2 |
| | 6-7 | 600 | 300 | 1200 | 1.5 | 1.2 | B-11 | 650 | 350 | 1350 | 0.6 | 0.4 |
| 3 | | | | | | | | | | | | |
| 4 | 8-20 | 850 | 325 | 1500 | 0.2 | 0.15 | | | | | | |
| | 7-20 | 800 | 275 | 1350 | 0.35 | 0.25 | | | | | | |
| 5 | 8-20 | 500 | 250 | 1000 | 0.3 | 0.2 | | | | | | |
| | 7-20 | 500 | 250 | 1000 | 0.5 | 0.3 | | | | | | |
| 6 | 9-20 | 700 | 325 | 1350 | 0.2 | 0.1 | | | | | | |
| | 9-20 | 700 | 325 | 1350 | 0.4 | 0.2 | | | | | | |
| 7 | | | | | | | | | | | | |
| 8 | 6-7 | 600 | 300 | 1200 | 0.3 | 0.2 | | | | | | |
| | 6-7 | 600 | 300 | 1200 | 0.5 | 0.3 | | | | | | |

TABLE 4

| No. | block 5 (upper line:upper rolls; lower line:lower rolls) hearth rolls (No.) | Lc (mm) | L1 (mm) | Lc + 2 × L1 (mm) | R1 ($10^{-3}$) | R2 ($10^{-3}$) | *2 meandering budkling | remarks |
|---|---|---|---|---|---|---|---|---|
| 1 | | | | | | | ≧50% | present |
| | | | | | | | ≧50% | invention |
| 2 | 12-20 | 750 | 400 | 1550 | 0.15 | 0.05 | ≧50% | present |
| | 12-20 | 750 | 400 | 1550 | 0.2 | 0.1 | ≧50% | invention |
| 3 | | | | | | | ≧50% | present |
| | | | | | | | ≧50% | invention |
| 4 | | | | | | | ≧50% | present |
| | | | | | | | ≧50% | invention |

TABLE 4-continued

| | block 5 (upper line:upper rolls; lower line:lower rolls) | | | | | | | |
|---|---|---|---|---|---|---|---|---|
| | hearth | | | Lc + | | | *2 | |
| No. | rolls (No.) | Lc (mm) | L1 (mm) | 2 × L1 (mm) | R1 ($10^{-3}$) | R2 ($10^{-3}$) | meandering budkling | remarks |
| 5 | | | | | | | ≧50% | present |
| | | | | | | | ≧50% | invention |
| 6 | | | | | | | 40% | present |
| | | | | | | | 40% | invention |
| 7 | | | | | | | 40% | present |
| | | | | | | | 40% | invention |
| 8 | | | | | | | 45% | present |
| | | | | | | | 45% | invention |

*2:(sheetpassingspeed)−(steadysheetpassingspeed)×100%
(steady sheet passing speed)

What is claimed is:

1. A hearth roll for use in a heating/soaking furnace of a vertical heat treating furnace, comprising a flat section at a central portion and two-stepped taper sections on opposed sides of the flat section, the taper sections including first taper sections and second taper sections, wherein the inclination of each of the first taper sections continuous to said flat section is larger than the inclination of each of the second taper sections continuous to each of said first taper sections, and the length Lc (mm) of said flat section and the length L1 (mm) of each of said first taper sections have the relationship given by the following formulas (1) and (2):

$$0.5\ W\min \leqq Lc \leqq W\min \quad (1)$$

$$W\min \leqq Lc+2\times L1 \leqq W\max-400 \quad (2)$$

where,

Wmin is a minimum width (mm) of a metal strip to be subjected to heat treatment, and Wmax is a maximum width (mm) of the metal strip to be subjected to heat treatment.

2. The hearth roll according to claim 1, wherein a convex curve section and a concave curve section are formed at a boundary between said flat section and each of said first taper sections, and at a boundary between each of said first taper sections and each of said second taper sections, respectively, and each of said convex and concave sections has a radius of curvature of at least 20 m.

3. The hearth roll according to claim 2, wherein each of said first taper sections have an inclination R1 within the range of $0.2\times10^{-3}$ to $10\times10^{-3}$, and each of said second taper sections have an inclination R2 within the range of $0.05\times10^{-3}$ to $4\times10^{-3}$.

4. A vertical heat treating furnace, comprising:

a heating/soaking furnace;

an inlet;

a outlet;

an intermediate portion between the inlet and the outlet; and a plurality of hearth rolls according to claim 3 used as transfer rolls and disposed between the inlet and the outlet;

wherein the hearth rolls disposed at the inlet of the vertical heat treating furnace satisfy the following formulas (3) and (4), the hearth rolls disposed from the intermediate portion to the outlet satisfy the following formulas (5) and (6), and the lengths Lc and (Lc+2×L1) of the hearth rolls are increased from the inlet to the outlet of the vertical heat treating furnace, stepwise or sequentially, in the hearth roll groups of the respective ones upper rolls and lower rolls disposed side by side in the vertical heat treating furnace:

$$0.5\ W\min \leqq Lc \leqq 0.7\ W\min, \quad (3)$$

$$W\min \leqq Lc+2\times L1 \leqq (W\min+W\max-400)/2, \quad (4)$$

$$0.7\ W\min \leqq Lc \leqq W\min, \quad (5)$$

$$(W\min+W\max-400)/2 \leqq Lc+2\times L1 \leqq W\max-400 \quad (6)$$

5. A vertical heat treating furnace according to claim 4, further comprising partition plates disposed at least between the hearth rolls of a former half section of the heating/soaking furnace and heating elements.

6. A vertical heat treating furnace, comprising:

a heating/soaking furnace;

an inlet;

an outlet;

an intermediate portion between the inlet and the outlet; and a plurality of the hearth rolls according to claim 4 used as transfer rolls;

wherein the hearth rolls disposed at the inlet of the vertical heat treating furnace satisfy the following formulas (3), (4), (7) and (8), the hearth rolls disposed from the intermediate portion to the outlet satisfy the following formulas (5), (6), (9), and (10), and the lengths Lc and (Lc+2×L1) are increased from the inlet to the outlet, stepwise or sequentially, in the hearth roll groups of the respective ones of upper rolls and lower rolls disposed side by side in the vertical treat heating furnace, and the inclinations R1 and R2 of the first and second taper sections, respectively, are reduced from the inlet to the outlet of the vertical heat treating furnace, stepwise or sequentially:

$$0.5\ W\min \leqq Lc \leqq 0.7\ W\min \quad (3)$$

$$W\min \leqq Lc+2\times L1(W\min+W\max-400)/2 \quad (4)$$

$$0.7\ W\min \leqq Lc \leqq W\min \quad (5)$$

$$(W\min+W\max-400)/2 \leqq Lc+2\times L1 \leqq W\max-400 \quad (6)$$

$$3.0\times10^{-3} \leqq R1 \leqq 10\times10^{-3} \quad (7)$$

$$1.2\times10^{-3}\leqq R2\leqq4.0\times10^{-3} \quad (8)$$

$$0.2\times10^{-3}\leqq R1\leqq3.0\times10^{-3} \quad (9)$$

$$0.05\times10^{-3}\leqq R2\leqq1.2\times10^{-3} \quad (10)$$

7. A vertical heat treating furnace, comprising:

a heating/soaking furnace;

an inlet;

a outlet;

an intermediate portion between the inlet and the outlet; and a plurality of hearth rolls according to claim 2 used as transfer rolls and disposed between the inlet and the outlet;

wherein the hearth rolls disposed at the inlet of the vertical heat treating furnace satisfy the following formulas (3) and (4), the hearth rolls disposed from the intermediate portion to the outlet satisfy the following formulas (5) and (6), and the lengths Lc and (Lc+2×L1) of the hearth rolls are increased from the inlet to the outlet of the vertical heat treating furnace, stepwise or sequentially, in the hearth roll groups of the respective ones of upper rolls and lower rolls disposed side by side in the vertical heat treating furnace:

$$0.5\ W\min\leqq Lc\ \leqq0.7\ W\min, \quad (3)$$

$$W\min\leqq Lc+2\times L1\leqq(W\min+W\max-400)/2, \quad (4)$$

$$0.7\ W\min\leqq Lc\leqq W\min, \quad (5)$$

$$(W\min+W\max-400)/2\leqq Lc+2\times L1\leqq W\max-400 \quad (6)$$

8. A vertical heat treating furnace according to claim 7, further comprising partition plates disposed at least between the hearth rolls of a former half section of the heating/soaking furnace and heating elements.

9. The hearth roll according to claim 1, wherein each of the said first taper sections have an inclination R1 within the range of $0.2\times10^{-3}$ to $10\times10^{-3}$, and each of the second taper sections have an inclination R2 within the range of $0.05\times10^{-3}$ to $4\times10^{-3}$.

10. A vertical heat treating furnace, comprising:

a beating/soaking furnace;

an inlet;

a outlet;

an intermediate portion between the inlet and the outlet; and a plurality of hearth rolls according to claim 3 used as transfer rolls and disposed between the inlet and the outlet;

wherein the hearth rolls disposed at the inlet of the vertical heat treating furnace satisfy the following formulas (3) and (4), the hearth rolls disposed from the intermediate portion to the outlet satisfy the following formulas (5) and (6j, and the lengths Lc and (Lc+2×L1) of the hearth rolls are increased from the inlet to the outlet of the vertical heat treating furnace, stepwise or sequentially, in the hearth roll groups of the respective ones of upper rolls and lower rolls disposed side by side in the vertical heat treating furnace:

$$0.5\ W\min\leqq Lc\leqq0.7\ W\min \quad (3)$$

$$W\min\leqq Lc+2\times L1(W\min+W\max-400)/2, \quad (4)$$

$$0.7\ W\min\leqq Lc\leqq W\min, \quad (5)$$

$$(W\min+W\max-400)/2\leqq Lc+2\times L1\leqq W\max-400 \quad (6)$$

11. A vertical heat treating furnace according to claim 10, further comprising partition plates disposed at least between the hearth rolls of a former half section of the heating/soaking furnace and heating elements.

12. A vertical heat treating furnace, comprising:

a heating/soaking furnace;

an inlet;

an outlet;

an intermediate portion between the inlet and the outlet; and a plurality of the hearth rolls according to any claim 3 used as transfer rolls;

wherein the hearth rolls disposed at the inlet of the vertical heat treating furnace satisfy the following formulas (3), (4), (7) and (8), the hearth rolls disposed from the intermediate portion to the outlet satisfy the following formulas (5), (6), (9), and (10), and the lengths Lc and (Lc+2×L1) are increased from the inlet to the outlet, stepwise or sequentially, in the hearth roll groups of the respective ones of upper rolls and lower rolls disposed side by side in the vertical treat heating furnace, and the inclinations R1 and R2 of the first and second taper sections, respectively, are reduced from the inlet to the outlet of the vertical heat treating furnace, stepwise or sequentially:

$$0.5\ W\min\leqq Lc\leqq0.7\ W\min \quad (3)$$

$$W\min\leqq Lc+2\times L1(W\min+W\max-400)/2 \quad (4)$$

$$0.7\ W\min\leqq Lc\leqq W\min \quad (5)$$

$$(W\min+W\max-400)/2\leqq Lc+2\times L1\leqq W\max-400 \quad (6)$$

$$3.0\times10^{-3}\leqq R1\leqq10\times10^{-3} \quad (7)$$

$$1.2\times10^{-3}\leqq R2\leqq4.0\times10^{-3} \quad (8)$$

$$0.2\times10^{-3}\leqq R1\leqq3.0\times10^{-3} \quad (9)$$

$$0.05\times10^{-3}\leqq R2\leqq1.2\times10^{-3} \quad (10)$$

13. A vertical heat treating furnace according to claim 12, further comprising partition plates disposed at least between the hearth rolls of a former half section of the heating/soaking furnace and heating elements.

14. A vertical heat treating furnace, comprising:

a heating/soaking furnace;

an inlet;

a outlet;

an intermediate portion between the inlet and the outlet; and a plurality of hearth rolls according to claim 1 used as transfer rolls and disposed between the inlet and the outlet;

wherein the hearth rolls disposed at the inlet of the vertical heat treating furnace satisfy the following formulas (3) and (4), the hearth rolls disposed from the intermediate portion to the outlet satisfy the following formulas (5) and (6), and the lengths Lc and (Lc+2×L1) of the hearth rolls are increased from the inlet to the outlet of the vertical heat treating furnace, stepwise or sequentially, in the hearth roll groups of the respective ones of upper rolls and lower rolls disposed side by side in the vertical heat treating furnace:

$$0.5\ W\min \leqq Lc \leqq 0.7\ W\min, \quad (3)$$

$$W\min \leqq Lc + 2 \times L1 \leqq (W\min + W\max - 400)/2, \quad (4)$$

$$0.7\ W\min \leqq Lc \leqq W\min, \quad (5)$$

$$(W\min + W\max - 400)/2 \leqq Lc + 2 \times L1 \leqq W\max - 400 \quad (6)$$

15. A vertical heat treating furnace according to claim 14, further comprising partition plates disposed at least between the hearth rolls of a former half section of the heating/soaking furnace and heating elements.

* * * * *

UNITED STATES PATENT AND TRADEMARK OFFICE

CERTIFICATE OF CORRECTION

PATENT NO. : 6,238,209 B1
DATED : May 29, 2001
INVENTOR(S) : Sachihiro Iida

It is certified that error appears in the above-identified patent and that said Letters Patent is hereby corrected as shown below:

Claim 6,
Line 7, change "4" to -- 3 --.

Claim 10,
Line 7, change "3" to -- 9 --.

Claim 12,
Line 7, change "3" to -- 9 --.

Signed and Sealed this

Fifth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,238,209 B1
DATED : May 29, 2001
INVENTOR(S) : Sachihiro Iida

It is certified that error appears in the above-identified patent and that said Letters Patent is hereby corrected as shown below:

Drawings,
Figure 5, in the upper left corner of the graph, change "(OCCURRENCE OF MEANDERING)" to -- (OCCURRENCE OF BUCKLING) --.
Figure 5, in the bottom center of the graph, change "(OCCURRENCE OF BUCKLING)" to -- "(OCCURRENCE OF MEANDERING) --

Column 1,
Line 46, change "Thus,," to -- Thus, --.
Line 60, change "role" to -- roll --.

Column 3,
Line 45, change "problem" to -- problems --.
Line 47, change "an" to -- as --.
Line 64, change "Wmin ≤ Lc + 2 X L1 (Wmin + Wmax - 400)/2" to -- Wmin ≤ Lc + 2 X L1 ≤ (Wmin + Wmax - 400)/2 --.

Column 6,
Line 38, change "hating" to -- having --.

Column 8,
Line 9, change "same" to -- some --.
Line 20, delete "been".

Column 9,
Table 1 in the row for case 7 and under the column for "buckling", change "O" to -- X --.
Table 1 in the row for case 8 and under the column for "meandering", change "O" to -- X --.
Line 34, delete "buckling substantially did not occur, but".
Line 34, change "meandering" to -- buckling --.
Line 35, after "occurred", insert -- in a wide material --.
Line 36, after "-turbed", insert -- Also, in a narrow material wherein formula (1) is not satisfied, meandering was liable to occur. --
Line 38, change "buckling" to -- meandering --.
Line 38, change "wide" to -- narrow --.
Lines 39-40, delete ", while the occurrence of meandering was suppressed" and thereafter insert -- Also in the case 8, formula (1) is not satisfied and therefore buckling frequently occurred."

UNITED STATES PATENT AND TRADEMARK OFFICE

CERTIFICATE OF CORRECTION

PATENT NO. : 6,238,209 B1
DATED : May 29, 2001
INVENTOR(S) : Sachihiro Iida

It is certified that error appears in the above-identified patent and that said Letters Patent is hereby corrected as shown below:

Column13,
Line 58, change “a” to -- an --.

Column 15,
Line 10, change “a” to -- an --.
Line 45, change “beating/soaking” to -- heating/soaking --.
Line 47, change “a” to -- an --.

Column 16,
Line 52, change “a” to -- an --.

Signed and Sealed this

Twenty-sixth Day of April, 2005

JON W. DUDAS
*Director of the United States Patent and Trademark Office*